US005462615A

United States Patent [19]

Von Hagen et al.

[11] Patent Number: 5,462,615

[45] Date of Patent: Oct. 31, 1995

[54] WELDABLE HIGH-STRENGTH STRUCTURAL STEEL WITH 13% CHROMIUM

[75] Inventors: Ingo Von Hagen, Krefeld; Rolf Popperling, Mülheim; Hubertus Schlerkmann, Roetgen; Ulrike Zeislmair, Meerbusch, all of Germany

[73] Assignee: Mannesmann Aktiengesellschaft, Dusseldorf, Germany

[21] Appl. No.: 244,334

[22] PCT Filed: Nov. 23, 1992

[86] PCT No.: PCT/DE92/00987

§ 371 Date: Jul. 25, 1994

§ 102(e) Date: Jul. 25, 1994

[87] PCT Pub. No.: WO93/11270

PCT Pub. Date: Jun. 10, 1993

[30] Foreign Application Priority Data

Dec. 5, 1991 [DE] Germany ..... 41 40 459.9

[51] Int. Cl.[6] ..... C21D 8/02; C21D 8/10

[52] U.S. Cl. ..... 148/592; 148/597; 148/609; 148/661

[58] Field of Search ..... 148/592, 597, 148/609, 661, 325; 420/69

[56] References Cited

U.S. PATENT DOCUMENTS 4,844,755 7/1989 Hashimoto et al. ..... 420/69

FOREIGN PATENT DOCUMENTS 288716 3/1990 Japan ..... 148/592

*Primary Examiner*—Deborah Yee

*Attorney, Agent, or Firm*—Cohen, Pontani, Lieberman, Pavane

[57] ABSTRACT

Disclosed is a process for producing seamless steel pipes or flat products (strip or sheet) for pipes or vessels which are intended for the conveyance, transport or processing of gaseous or liquid hydrocarbons containing $CO_2$ and water and possibly small proportions of $H_2S$ and are resistant to stress crack corrosion and have good welding properties at the same time and a 0.2-percent elongation limit of at least 450 N/mm$^2$. The process uses a nickel-containing steel of the following composition (percent by weight): min. 0.015% C, 0.15–0.50% Si, max. 2.00% Mn, max. 0.020% P, max. 0.003% S, 12.0–13.8% Cr, 0.002–0.02% N, 0.01–0.05% Nb, remainder iron and usual impurities. It is presently suggested that the nickel content is limited to a maximum of 0.25%, the manganese content amounts to at least 1.0%, the carbon content is limited to 0.035%, and 0.01 to 1.2% molybdenum is contained as additional alloying component.

12 Claims, 2 Drawing Sheets

WELDABLE HIGH-STRENGTH STRUCTURAL STEEL WITH 13% CHROMIUM

BACKGROUND OF THE INVENTION

I. Field of the Invention

The invention is directed to a process for producing seamless steel pipes or flat products (strips, sheets) for pipes or vessels for the conveyance, transporting or processing of hydrocarbons. Corrosive conditions exist when $CO_2$ and water and possibly small proportions of $H_2S$ are present in the media to be transported or processed.

II. Discussion of the Prior Art

For production or working of hydrocarbons under corrosive conditions, pipes made of low-alloy steels with passive corrosion protection (inhibition) or high-alloy corrosion-resistant steels are normally used to meet the strict requirements respecting resistance to corrosion, in particular also resistance to stress crack corrosion. A suitable steel is known from DE 26 16 599 C2, for example. Due to the high proportion of expensive alloying elements (e.g., 22% Cr, 5% Ni, 3% Mo), pipes and vessels made from such steels are extremely cost-intensive when used for the aforementioned purpose. These relatively high-strength compound or duplex steels usually have a low carbon content and can therefore be welded easily.

Steels containing 0.18 to 0.22 % carbon and 12.5 to 14% chromium (AISI 420) are also known for use in oil fields. This material has very good resistance to corrosion in a moist $CO_2$ environment. Since it is practically impossible to weld pipes produced from this material under construction site conditions, the pipes are connected exclusively by screw connections. Therefore, pipes produced from such steels are used only as conveying pipes, but not as line pipes. If traces of $H_2S$ are also contained in the hydrocarbons to be conveyed through the pipes, damage may occur as a result of stress crack corrosion, since this work material has only a comparatively low resistance to this type of corrosion.

Further, weldable 13-percent chromium steels are also known for producing steel pipes. An example is AISI 410 (work material No. 1.4006) which contains 0.08 to 0.12% carbon, a maximum of 1.0% manganese and 12.0 to 14.0% chromium. The weldability of this steel is ensured by the low carbon content. However, heat treatment of rolled products produced from this steel is often problematic as it frequently results in an inhomogeneous joint which is responsible for the very poor resistance of these steels to stress crack corrosion in the presence of $H_2S$. For this reason, this work material which is considered resistant to rust and acids is used for pump pipes, heat exchangers and the like, but not for conveying hydrocarbons. It is used for accoutrements or fittings in the region of the bore shaft head only as cast or forged products. Its limited resistance to corrosion has been sufficiently documented in written reports relating to cases of damage.

Finally, a steel is known from JP 57-5849 for the production of seamless steel pipes having the following composition:

| | | |
|---|---|---|
| max. | 0.015% | C |
| | 0.10–0.80% | Si |
| | 0.10–2.00% | Mn |
| max. | 0.025% | P |

-continued

| | | |
|---|---|---|
| max. | 0.010% | S |
| | 11.0–17.0% | Cr |
| | 0.10–3.00% | Ni |
| max. | 0.015% | N |
| | 0.01–0.05% | Nb |
| | 0.01–0.10% | Al |

remainder iron and usual impurities.

SUMMARY OF THE INVENTION

This steel is described as being weldable and having tensile strength, toughness and resistance to corrosion. The seamless steel pipes produced from this steel have a yield point in the range of 428 to 502N/mm$^2$ after heat treatment. Adherence to the given maximum limit of 0.015% for carbon and 0.015 % for nitrogen is of decisive importance for ensuring resistance to corrosion. There is no molybdenum provided in this steel.

In contrast, steels of the present invention have the following composition:

| | |
|---|---|
| min. 0.015% | C |
| 0.15–0.50% | Si |
| max. 2.00% | Mn |
| max. 0.020% | P |
| max. 0.003% | S |
| 12.0–13.8% | Cr |
| 0.002–0.02% | N |
| 0.01–0.05% | Nb |

remainder iron and usual impurities, wherein the nickel content is limited to a maximum of 0.25, in that the manganese content is at least 1.0%, in that the carbon content is limited to 0.035%, and in that 0.01 to 1.2% molybdenum is contained as additional alloying component (% is weight percent). It has been found within the framework of the present invention that a steel having this composition not only possesses excellent characteristics with respect to resistance to corrosion, good weldability and toughness, but further enables even a 0.2% elongation limit which is substantially higher than the values known from JP 57-5849. This is due in particular to the surprising insight that the nickel content which may amount to 3.0% in known steels must be limited to a maximum of 0.25%. Given this precondition, a C content in the range of 0.015% to 0.035% and a N content in the range of 0.002 to 0.02% can be allowed for the rest of the alloying elements within the framework of the weight percents values indicated above for the present invention. This opens up new possibilities with respect to mechanical properties. In contrast to the known steel, the steel used according to the invention also contains molybdenum, specifically from 0.01% to 1.2%. This molybdenum content is advantageously limited to a maximum of 0.2 to 0.3%. The minimum content of manganese is 1.0%, whereas substantially lower manganese contents of up to 0.1% are permissible in the known steel; the upper limit is 2.0%. The chromium content is in the range of 12.0 to 13.8%. Values ranging from 0.02 to 0.04% have proven particularly advantageous for addition of niobium; however, a range of 0.01 to 0.05% is also permissible. Since the carbon content is limited to 0.015 to 0.035%, these steels have good welding properties. A silicon content of 0.15 to 0.50% and a manganese content of 1.0 to 2.0% are recommended. Phosphorous and sulfur impurities are limited to a maximum of 0.020% and 0.003%, respectively.

DETAILED DESCRIPTION OF THE PRESENTLY PREFERRED EMBODIMENTS

The importance of adhering exactly to the present content limits of the individual alloying elements provided according to the invention is shown, for example, by a steel of the following composition used as a comparison example in JP 57-5849 for the invention disclosed therein:

| | |
|---|---|
| 0.020% | C |
| 0.30% | Si |
| 0.52% | Mn |
| 0.009% | P |
| 0.004% | S |
| 0.73% | Ni |
| 13.1% | Cr |
| 0.026% | Nb |
| 0.025% | Al |
| 0.011% | N |

remainder iron and usual impurities.

This steel, which differs from the steel of the present invention in its content of Mn, Mo and Ni by a maximum of roughly half a percentage point, has been shown not to be resistant to corrosion.

There are a number of possibilities for the steel used according to the invention with respect to processing in commercial rolling. For example, when producing sheets or plates for vessels or welded pipes, the input stock or primary material should be heated to 1100°–1250° C., broken down in a first rolling phase at temperatures above 1000° C., and then final-rolled in a second rolling phase at temperatures ranging from 850° C. to 750° C. with a minimum deformation of 30%.

The second rolling phase is preferably carried out in such a way that cooling is accelerated from a final rolling temperature greater than or equal to 850° C. to less than 200° C. at a cooling rate of at least 5 K/s. Further cooling can be carried out in air. Subsequent tempering is recommended, but not absolutely necessary.

In another advantageous process variant of the invention, cooling to ambient temperature is effected from a final rolling temperature greater than or equal to 850° C. at a cooling rate of 0.5 to 2 K/s.

For a targeted adjustment of narrow tension widths within the strength values of the products (e.g. 15 ksi), these products can be heat-treated in a manner known per se in a separate process step.

Figure 1:
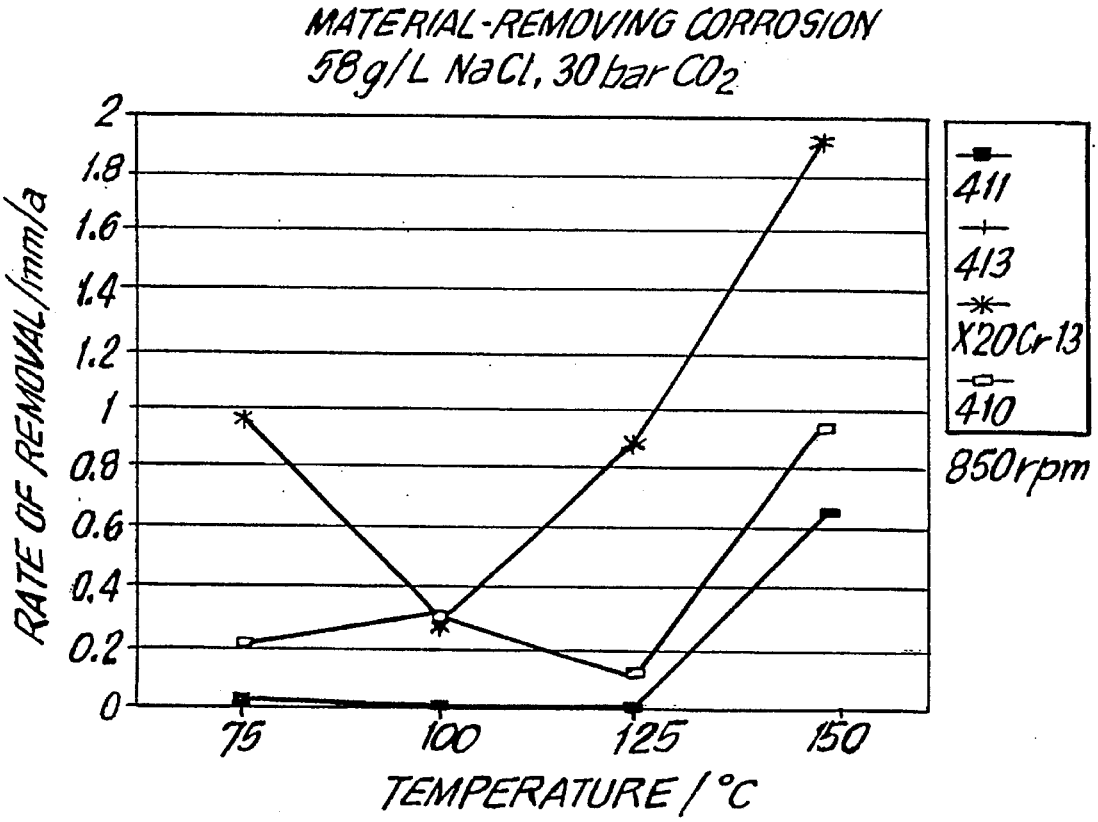
FIG. 1 shows a first comparison of material-removing corrosion of a steel of the present invention and other steels.
Figure 2:
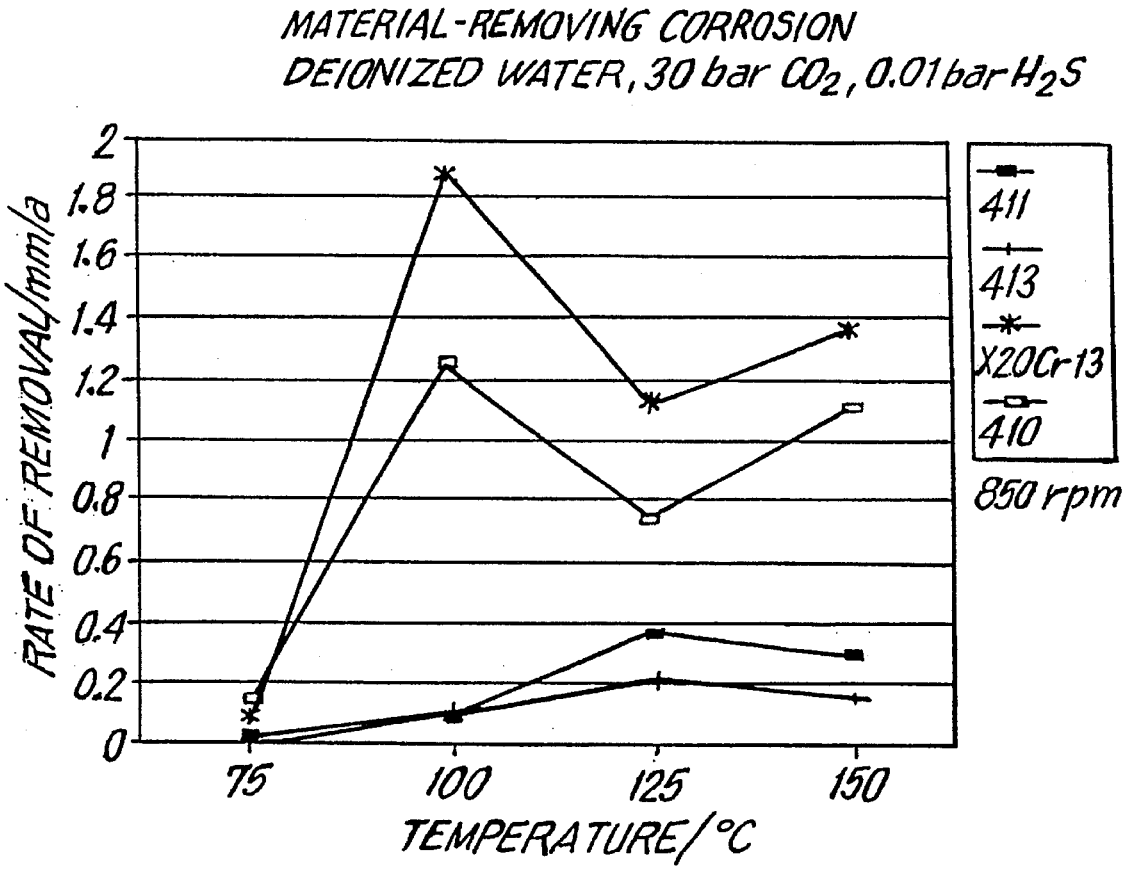
FIG. 2 shows a second comparison of material-removing corrosion of a steel of the present invention and other steels.

The invention is explained in more detail in the following with reference to comparison examples and test results. FIGS. 1 and 2 show measurement results with respect to material-removing corrosion for different steels under different conditions.

The chemical compositions of three different 13%-chromium steels 410, 411 and 413 are compiled in Table 1. Steel 410 corresponds to the present invention, while the other two steels are used as comparison examples. Steel 411 differs from the invention in its Ni content of 2.09%. Steel 413 is distinguished from the present invention in that its contains too little manganese at 0.57% and too much nickel at 4.19%. Table 2 shows the mechanical-technical properties for flat products and pipes produced under different rolling conditions and heattreatment conditions. In Table 2, $R_{p0.2}$ is upper yield stress, $R_m$ is tensile strength and $A_5$ is elongation. A thermomechanically rolled or TM-rolled sheet which is case-hardened at 1140° C. and final-rolled at 800° C. achieved the excellent mechanical properties shown in the first line under work number 410A without tempering treatment. By lowering the final rolling temperature to 750° C. (work number 410B), an additional increase in strength values was achieved, although the toughness characteristics are slightly impaired. The test results indicated in the lower section of Table 2 (work numbers 410.1 to 410.5) show the influence of a heat treatment by hardening and tempering under different conditions but under identical rolling conditions. The considerable increases in the values achieved with respect to strength and toughness characteristics are clearly indicated.

Table 3 shows that the steel 410 according to the invention is definitely superior to the known steels 411 and 413 with respect to resistance to stress crack corrosion. Only under very extreme test conditions (0.01 bar $H_2S$ and 5% NaCl) was there a failure of the round tensile specimen in steel 410 after 1000 hours at a load of 90% $R_{p0.2}$. The comparison steels already showed failures of specimens under substantially less severe test conditions.

FIGS. 1 and 2 show the resistance of the steel according to the invention to material-removing corrosion under different conditions compared with steels 411 and 413 and a steel X20Cr13. In consideration of the analysis values from Table 1, it follows that increased contents of nickel and particularly molybdenum reduce the rate of material-removing corrosion. However, as shown in particular in comparison with steel X20Cr13, the resistance of steel 410 according to the invention is still quite good. As is shown in Table 3, the comparison steels 411 and 413 with their higher nickel and molybdenum contents are clearly inferior to the steel according to the invention with respect to resistance to stress crack corrosion in spite of their improved resistance to material-removing corrosion. Surprisingly, the reason for the success of the invention consists in the drastically limited Ni content and Mo content. If resistance to stress crack corrosion is viewed as more important than resistance to material-removing corrosion, the Mo content should even be limited to values below 0.2 %.

TABLE 1

| | Chemical composition of analyzed work materials | | | | | | | | | | |
|---|---|---|---|---|---|---|---|---|---|---|---|
| No. | C % | Si % | Mn % | P % | S % | Al total % | Cr % | Ni % | Mo % | Nb % | N % |
| 410 | 0.028 | 0.29 | 1.43 | 0.006 | 0.002 | 0.01 | 12.98 | 0.055 | 0.042 | 0.028 | 0.0077 |

TABLE 1-continued

| | Chemical composition of analyzed work materials | | | | | | | | | | |
|---|---|---|---|---|---|---|---|---|---|---|---|
| No. | C % | Si % | Mn % | P % | S % | Al total % | Cr % | Ni % | Mo % | Nb % | N % |
| 411 | 0.029 | 0.30 | 1.47 | 0.007 | 0.002 | 0.006 | 13.32 | 2.09 | 0.97 | 0.031 | 0.0084 |
| 413 | 0.028 | 0,29 | 0.57 | 0.007 | 0,002 | 0.008 | 12.94 | 4.19 | 0.98 | 0.007 | 0.0226 |

TABLE 2

| Mechanical-technical properties of a work material according to the invention | | | | | | | | | |
|---|---|---|---|---|---|---|---|---|---|
| | | | | | Mechanical Properties | | | | |
| Work No. | $T_Z$ °C. | $T_E$ °C. | Hardening | Tempering | $R_{p0.2}$ N/mm² | $R_m$ N/mm² | $R_{p0.2}/R_m$ % | $A_5$ % | Z % |
| 410A | 1140 | 850 | TM-rolled | — | 676 | 969 | 70 | 17.5 | 61 |
| 410B | 1140 | 750 | TM-rolled | — | 689 | 978 | 70 | 16.5 | 59 |
| 410.1 | 1140 | 855 | 1000° C./oil | 450° C./air | 822 | 994 | 83 | 19.5 | 70 |
| 410.2 | 1140 | 855 | 1000° C./oil | 500° C./air | 807 | 999 | 81 | 19.0 | 74 |
| 410.3 | 1140 | 855 | 1000° C./oil | 600° C./air | 726 | 837 | 87 | 19.0 | 73 |
| 410.4 | 1140 | 855 | 1000° C./oil | 700° C./air | 658 | 760 | 87 | 18.5 | 74 |
| 410.5 | 1140 | 855 | 900° C./oil | 500° C./air | 820 | 994 | 83 | 20.0 | 74 |

TABLE 3

| Results of stress crack corrosion tests | | | | |
|---|---|---|---|---|
| Test conditions | | | | |
| $p(H_2S)$ | c(NaCl) | Results | | |
| bar | % | 410 | 411 | 413 |
| 0.001 | 0 | 0 | 0 | 0 |
| | 5 | 0 | X | X |
| 0.0035 | 0 | 0 | 0 | 0 |
| | 5 | 0 | X | X |
| 0.01 | 0 | 0 | n.t. | n.t. |
| | 0.5 | 0 | X | n.t. |
| | 5 | X | X | n.t. |

Round tensile specimens under constant load

Load: 90% $R_{p0.2}$

Test period: 1000 hours

Carrier gas: $CO_2$ under normal pressure

Symbols:

O: no results X: specimen failure n.t.: not tested

We claim:

1. A process for producing items selected from the group of seamless steel pipes, flat strip products for pipes and flat sheet products for vessels, said pipes and vessels being intended for the conveyance, transport or processing of hydrocarbons containing $CO_2$ and water and optionally small proportions of $H_2S$ and are resistant to stress crack corrosion and have good welding properties at the same time and a 0.2-percent elongation limit of at least 450 N/mm², the process comprising the steps of: heating a nickel-containing steel of the following weight percent composition:

| | |
|---|---|
| min. 0.015% | C |

-continued

| | |
|---|---|
| 0.15–0.50% | Si |
| max. 2.00% | Mn |
| max. 0.020% | P |
| max. 0.003% | S |
| 12.0–13.8% | Cr |
| 0.002–0.02% | N |
| 0.01–0.05% | Nb |

remainder iron and usual impurities, wherein the nickel content is more than 0.0% and is limited to a maximum of 0.25%, the manganese content is at least 1.0%, the carbon content is limited to 0.035%, and 0.01 to 1.2% molybdenum is contained as an additional alloying component, to 1100°–1250° C.; roughing the steel in a first rolling phase at temperatures up to a maximum of 1000° C.; and then final rolling the steel in a second rolling phase at temperatures ranging from 850° C. to 750° C. with a minimum deformation of 30% to make rolled products.

2. A process for producing items selected from the group of seamless steel pipes, flat strip products for pipes and flat sheet products for vessels, said pipes and vessels being intended for the conveyance, transport or processing of hydrocarbons containing $CO_2$ and water and optionally small proportions of $H_2S$ and are resistant to stress crack corrosion and have good welding properties at the same time and a 0.2-percent elongation limit of at least 450 N/mm², the process comprising the steps of: making the items from a nickel-containing steel of the following weight percent composition:

| | |
|---|---|
| min. 0.015% | C |
| 0.15–0.50% | Si |
| max. 2.00% | Mn |
| max. 0.020% | P |
| max. 0.003% | S |
| 12.0–13.8% | Cr |

-continued

| | |
|---|---|
| 0.002–0.02% | N |
| 0.01–0.05% | Nb |

remainder iron and usual impurities, wherein the nickel content is more than 0.0% and is limited to a maximum of 0.25%, the manganese content is at least 1.0%, the carbon content is limited to 0.035%, and 0.01 to 1.2% molybdenum is contained as an additional alloying component; rolling the steel; and cooling the steel from a final rolling temperature of at least 850° C. to less than 200° C. at a cooling rate of at least 5 K/s.

3. The process according to claim 2, wherein the molybdenum content is limited to a maximum of 0.20%.

4. The process according to claim 2 including adjusting the niobium content to a value between 0.02% and 0.04%.

5. A process for producing items selected from the group of seamless steel pipes, flat strip products for pipes and flat sheet products for vessels, said pipes and vessels being intended for the conveyance, transport or processing of hydrocarbons containing $CO_2$ and water and optionally small proportions of $H_2S$ and are resistant to stress crack corrosion and have good welding properties at the same time and a 0.2-percent elongation limit of at least 450 $N/mm^2$, the process comprising the steps of: making the items from a nickel-containing steel of the following weight percent composition:

| | |
|---|---|
| min. 0.015% | C |
| 0.15–0.50% | Si |
| max. 2.00% | Mn |
| max. 0.020% | P |

-continued

| | |
|---|---|
| max. 0.003% | S |
| 12.0–13.8% | Cr |
| 0.002–0.02% | N |
| 0.01–0.05% | Nb |

remainder iron and usual impurities, wherein the nickel content is more than 0.0% and is limited to a maximum of 0.25%, the manganese content is at least 1.0%, the carbon content is limited to 0.035%, and 0.01 to 1.2% molybdenum is contained as an additional alloying component; rolling the steel; and cooling the steel to ambient temperature from a final rolling temperature of at least 850° C. at a cooling rate of 0.5 to 2 K/s.

6. The process according to claim 5, wherein the molybdenum content is limited to a maximum of 0.20%.

7. The process according to claim 5, including adjusting the niobium content to a value between 0.02% and 0.04%.

8. The process according to claim 5, further comprising heat treating the rolled products separately to adjust the desired degree of strength.

9. The process according to claim 1, wherein the molybdenum content is limited to a maximum of 0.20%.

10. The process according to claim 1, including adjusting the niobium content to a value between 0.02% and 0.04%.

11. The process according to claim 3, further comprising tempering separately after the cooling.

12. The process according to claim 1, further comprising heat treating the rolled products separately to adjust the desired degree of strength.

* * * * *